US009208724B2

(12) United States Patent
Kim

(10) Patent No.: US 9,208,724 B2
(45) Date of Patent: Dec. 8, 2015

(54) DISPLAY DEVICE AND METHOD OF DRIVING THE SAME

(71) Applicant: LG DISPLAY CO., LTD., Seoul (KR)

(72) Inventor: Binn Kim, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 189 days.

(21) Appl. No.: 13/891,690

(22) Filed: May 10, 2013

(65) Prior Publication Data

US 2013/0300776 A1 Nov. 14, 2013

(30) Foreign Application Priority Data

May 11, 2012 (KR) ..... 10-2012-0050545

(51) Int. Cl.
*G09G 3/32* (2006.01)

(52) U.S. Cl.
CPC ..... *G09G 3/3258* (2013.01); *G09G 3/3233* (2013.01); *G09G 3/3266* (2013.01); *G09G 2300/0852* (2013.01); *G09G 2300/0861* (2013.01)

(58) Field of Classification Search
USPC ..... 326/112; 327/256
See application file for complete search history.

(56) References Cited

U.S. PATENT DOCUMENTS

| | | | | |
|---|---|---|---|---|
| 6,339,631 | B1 * | 1/2002 | Yeo et al. | 377/64 |
| 2004/0100318 | A1 * | 5/2004 | Lim | 327/333 |
| 2006/0262074 | A1 * | 11/2006 | Shimoda | 345/100 |
| 2006/0284801 | A1 * | 12/2006 | Yoon et al. | 345/76 |
| 2007/0171179 | A1 * | 7/2007 | Morosawa | 345/100 |
| 2011/0242080 | A1 * | 10/2011 | Yamamoto et al. | 345/211 |
| 2013/0314139 | A1 * | 11/2013 | Umezaki | 327/208 |

FOREIGN PATENT DOCUMENTS

CN 1797155 A 7/2006

OTHER PUBLICATIONS

Office Action issued in Chinese Patent Application No. 201310170890.6, mailed Dec. 26, 2014, 13 pages.

* cited by examiner

*Primary Examiner* — Alexander Eisen
*Assistant Examiner* — Kebede Teshome
(74) *Attorney, Agent, or Firm* — Brinks Gilson & Lione

(57) ABSTRACT

A display device includes a display panel; and a control signal circuit that supplies a control signal to the display panel. The controls signal circuit includes a plurality of driving units and a plurality of reverse circuit, wherein the driving units are supplied with a clock signal and generate a first output pulse that has the same waveform as the clock signal, and wherein the reverse circuit reverses the first output pulse to generate a second output pulse that is an output of the control signal circuit.

6 Claims, 7 Drawing Sheets

DISPLAY DEVICE AND METHOD OF DRIVING THE SAME

The present application claims the priority benefit of Korean Patent Application No. 10-2012-0050545 filed in Republic of Korea on May 11, 2012, which are hereby incorporated by reference in its entirety.

BACKGROUND

1. Field of the Disclosure

The present disclosure relates to a display device, and more particularly, to a display device and a method of driving the same.

2. Discussion of the Related Art

With the advancement of information society, demand for a display device capable of displaying an image has increased in various forms. Recently, various flat panel display devices, such as a liquid crystal display (LCD), a plasma display panel (PDP), and an organic light emitting diode (OLED) display, have been used.

An OLED display emits light using organic materials radiating red, green and blue, and includes a display panel and a driving circuit.

The OLED display can be manufactured with simpler processes and lower cost than the LCD.

FIG. 1 is a circuit diagram of a pixel of an OLED display according to the related art, and FIG. 2 is a timing chart of control signals of the OLED display according to the related art.

Referring to FIG. 1, the pixel includes first to fourth switching elements S1 to S4, first and second capacitors C1 and C2, and an organic light emitting diode OLED.

The first to fourth switching elements S1 to S4 may be PMOS type transistors.

Source and gate electrodes of the first switching element S1 are supplied with a data signal Data and a select signal Select, respectively, and a drain electrode of the first switching element S1 is connected to an electrode of the first capacitor C1.

Source and gate electrodes of the second switching element S2 are connected to an electrode of the second capacitor C2 and the other electrode of the first capacitor C1, and a drain electrode of the second switching element S2 is connected to a drain electrode of the third switching element S3.

When the second switching element S2 is turned on, a current flows to the organic light emitting diode OLED and the organic light emitting diode OLED emits thus light. The second switching element S2 is referred to as a driving transistor.

A source electrode of the third switching element S3 is connected to the other electrode of the second capacitor C2, a gate electrode of the third switching element S3 is supplied with a control signal Control, and a drain electrode of the third switching element S3 is connected to a source electrode of the fourth switching element S4.

A source electrode of the fourth switching element S4 is connected to the drain electrode of the third switching element S3, a gate electrode of the fourth switching element S4 is supplied with a light emission control signal Em, and a drain electrode of the fourth switching element S4 is connected to an electrode of the organic light emitting diode OLED.

A light intensity of the organic light emitting diode is proportional to an amount of a current flowing thereto, and the amount of the current is proportional to an amplitude of the data signal Data applied to the gate electrode of the driving transistor S2.

Accordingly, various gray levels are shown with various amplitudes of the data signals Data, and images can be displayed.

The pixel is operated using a plurality of control signals, for example, the control signal Control, the light emission control signal Em, the select signal Select, and the like.

Referring to FIG. 2, the data signal Data, the control signal Control and the select signal Select are each a pulse signal which has a low level for a short time and a high level for the remaining long time.

Accordingly, the first and second switching elements S1 and S2 are turned on during a short time the low level is applied.

However, the light emission control signal Em is a pulse signal which has a high level for a short time and a low level for the remaining long time.

Accordingly, the fourth switching element S4 is turned on while a long time the low level is applied.

In case of the first to fourth switching elements S1 to S4 using NMOS type transistors, control signals having the opposite waveform are used.

A control signal circuit generating the control signals is explained as below.

FIG. 3 is a view illustrating a driving unit of a control signal circuit according to the related art, FIG. 4 is a timing chart of a clock signal and an output pulse of a Q node at the driving unit of the control signal circuit according to the related art, and FIG. 5 is a view timing chart of an output pulse at the driving unit of the control signal circuit according to the related art.

Referring to FIG. 3, the control signal circuit includes a plurality of control units 50.

The control unit 50 includes first and second transistors T1 and T2, and outputs an output pulse OUTPUT using a clock signal CLK and the like supplied from a timing control portion and the like.

The first and second transistors T1 and T2 may be PMOS type transistors.

The output pulse OUTPUT from each driving unit 50 is supplied to a switching element of a pixel and controls tuning-on/off the switching element.

The driving unit 50 functions to transfer the clock signal CLK to an output node N according to a Q signal and a Qb signal, which are voltages at Q node and Qb node, respectively.

Accordingly, the output pulse OUTPUT has the same waveform as the clock signal CLK.

However, the output pulse OUTPUT may be deformed at a certain time, which is explained with reference to FIG. 4.

Referring to FIG. 4, for a first time t1, the clock signal CLK maintains a low level, and the Q signal changes from a high level to a low level by a previous output pulse.

The previous output pulse may be a output pulse from a previous driving unit 50.

For a second time t2, the Q signal maintains a low level, and the clock signal CLK changes from a low level to a high level.

Accordingly, for the second time t2, the first transistor T1 is turned on and transfers the clock signal having a high level to the output node N, and the output pulse OUTPUT is output.

However, for the first time t1, the clock signal CLK has a low level, thus a Vgs (i.e., a voltage difference between gate and source electrodes) of the first transistor T1 becomes 0V, and thus the first transistor T1 is turned off. At the same time, the Qb node has a high level, and thus the second transistor T2 is also turned off. Accordingly, the output node N has an electrically floating state.

In other words, when the clock signal CLK and the Q signal have a low level at the same time, the Vgs of the is 0V, and the first transistor T1 is thus turned off, and at the same time, the Qb node is high level, and the second transistor is thus turned off, and finally, the output node N has a floating state.

As a result, referring to FIG. 5, the output pulse OUTPUT is deformed for the first time t1, and an abnormal output is caused as shown in a "B."

SUMMARY

A display device includes a display panel; and a control signal circuit that supplies a control signal to the display panel and including a plurality of driving units and a plurality of reverse circuit, wherein the driving unit is supplied with a clock signal and generates a first output pulse that has the same waveform as the clock signal, and wherein the reverse circuit reverses the first output pulse to generate a second output pulse that is an output of the control signal circuit.

In another aspect, a method of driving a display device includes generating a first output pulse that has the same waveform as a clock signal, and reversing the first output pulse to generating a second output pulse, through a control signal circuit, wherein the control signal circuit includes a plurality of driving units and a plurality of reverse circuits, is supplied with the clock signal, and supplies a control signal to a display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EXEMPLARY EMBODIMENTS

Reference will now be made in detail to exemplary embodiments, examples of which are illustrated in the accompanying drawings.

The embodiments as below are explained with an OLED display as an example of a display device, but it should be understood that other type displays may be employed.

Figure 6:
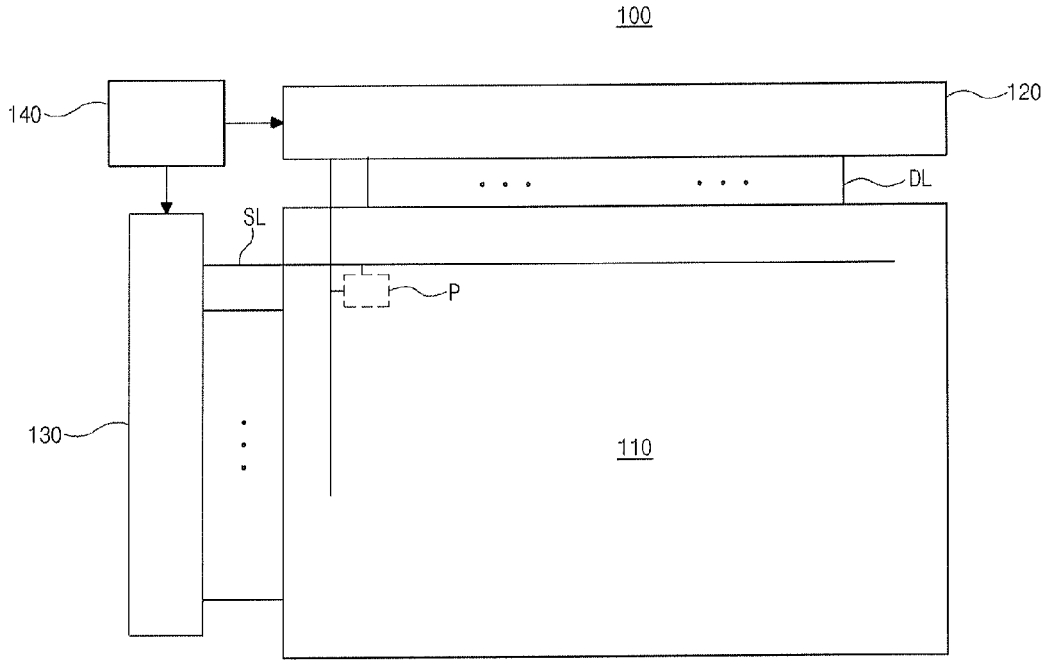
FIG. 6 is a schematic view illustrating a display device according to a first embodiment of the present invention.
Figure 7:
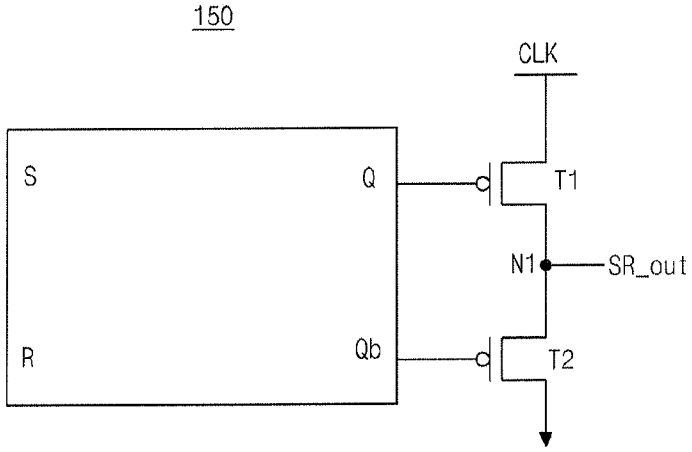
FIG. 7 is a view illustrating a driving unit of a control signal circuit according to the first embodiment of the present invention.
Figure 8:
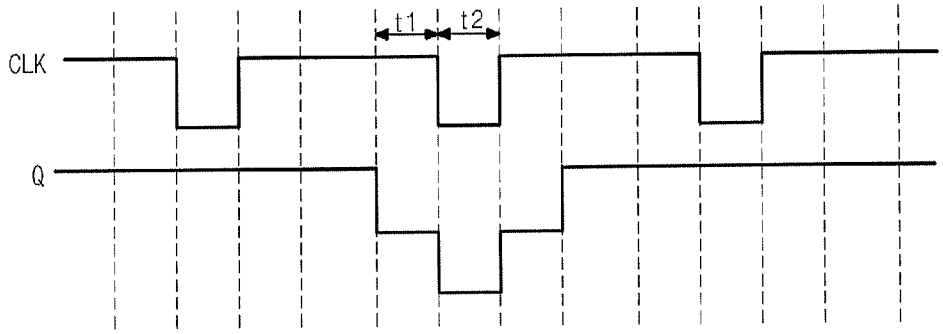
FIG. 8 is a timing chart of a clock signal and an output reverse pulse at a Q node of the driving unit according to the first embodiment of the present invention.
Figure 9:
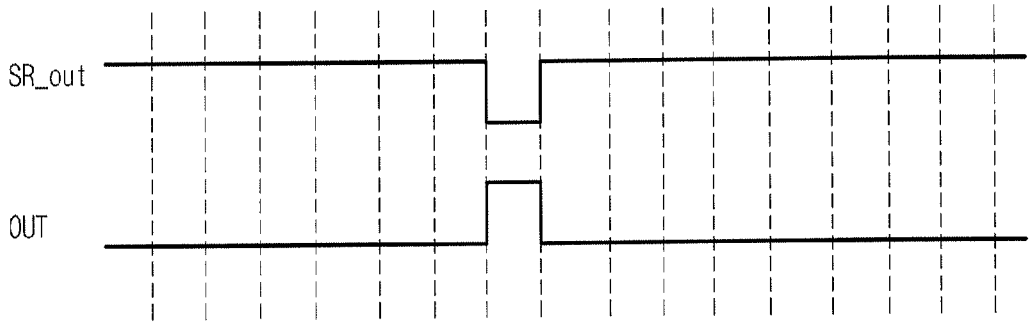
FIG. 9 is a timing chart of an output pulse and a reverse pulse at the driving unit according to the first embodiment of the present invention.

FIG. 6 is a schematic view illustrating a display device according to a first embodiment of the present invention, FIG. 7 is a view illustrating a driving unit of a control signal circuit according to the first embodiment of the present invention, FIG. 8 is a timing chart of a clock signal and an output reverse pulse at a Q node of the driving unit according to the first embodiment of the present invention, and FIG. 9 is a timing chart of an output pulse and a reverse pulse at the driving unit according to the first embodiment of the present invention.

Referring to FIG. 6, the display device 100 includes a display panel 110, a source driver 120, a gate driver 130 and a timing control portion 140.

The display panel 110 includes gate lines SL and data lines DL crossing each other to define pixel P.

Even though not shown in the drawings, in the pixel P, at least one switching element, driving element, a storage capacitor and an organic light emitting diode.

Regarding operation of the pixel P, a gate signal is supplied through the gate line SL and a switching element is thus turned on, and a data voltage is supplied through the data line DL and applied to a gate electrode of the driving element.

When the driving element is turned on, a current flows to the organic light emitting diode and light is emitted.

A light intensity of the organic light emitting diode is proportional to an amount of the current, and the amount of the current is proportional to an amplitude of the data voltage.

Accordingly, various gray levels are shown with various amplitudes of the data voltages, and images can be displayed.

The storage capacitor stores the data voltage during one frame and functions to keep the current and light luminance of the organic light emitting diode.

The source driver 120, which may include a plurality of source drive ICs, generates data voltages using image data and data control signals from the timing control portion 140, and supplies the data voltages to the display panel 110 through the data lines DL.

The gate driver 130, which may be formed in a GIP (gate in panel) type method, generates gate voltages using gate control signals from the timing control portion 140, and supplies the gate voltages to the display panel 110 through the gate lines GL.

The gate control signals may include a gate start pulse, a gate shift clock, and the like.

The timing control portion 140 may be supplied with image data and control signals, such as a horizontal synchronization signal, a vertical synchronization signal, and a data enable signal, from a system, such as a graphic card, through an LVDS (low voltage differential signaling) interface.

The timing control portion 140 may generate the gate control signals to control the gate driver 130 and the data control signals to control the source driver 120.

Even though not shown in the drawings, a power supply portion may be in the display device, which generates driving voltages to drive components of the display device 100.

Figure 1:
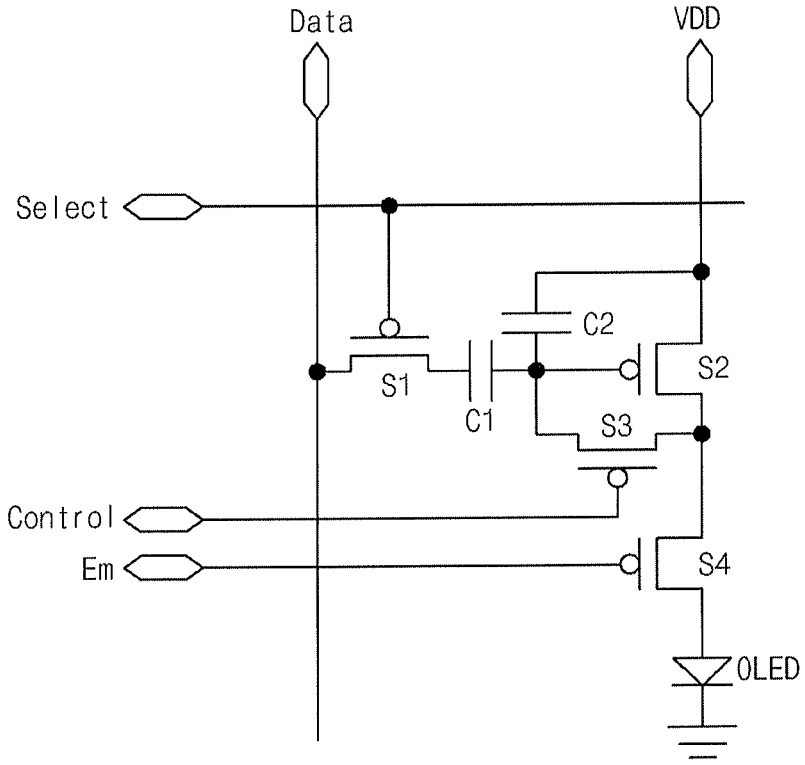
FIG. 1 RELATED ART
FIG. 1 is a circuit diagram of a pixel of an OLED display according to the related art.
Figure 2:
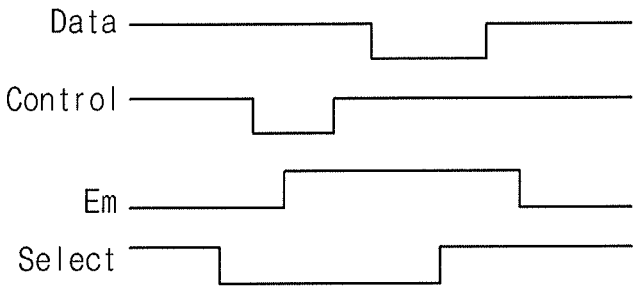
FIG. 2 RELATED ART
FIG. 2 is a timing chart of control signals of the OLED display according to the related art.
Figure 3:
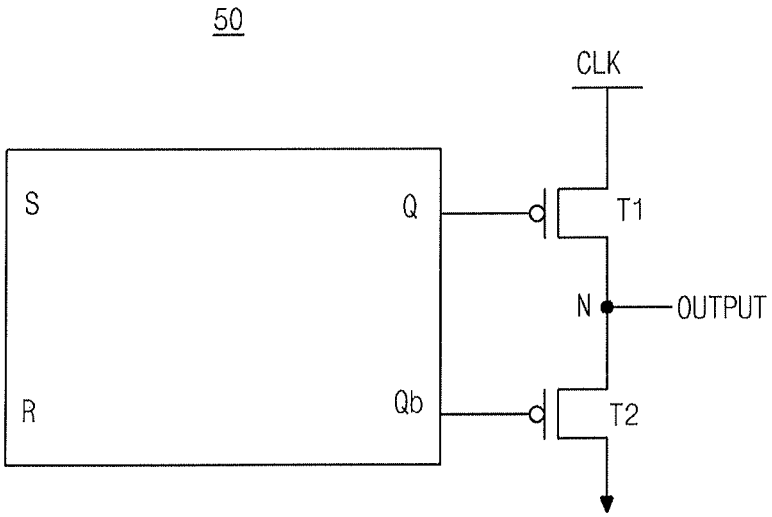
FIG. 3 RELATED ART
FIG. 3 is a view illustrating a driving unit of a control signal circuit according to the related art.
Figure 4:
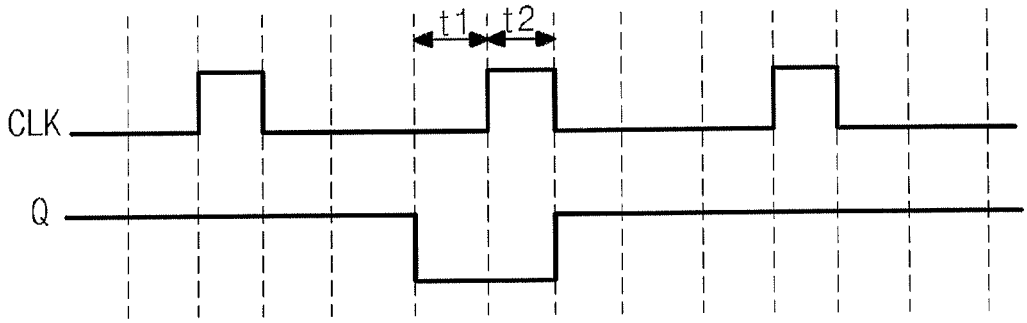
FIG. 4 RELATED ART
FIG. 4 is a timing chart of a clock signal and an output pulse of a Q node at the driving unit of the control signal circuit according to the related art.
Figure 5:
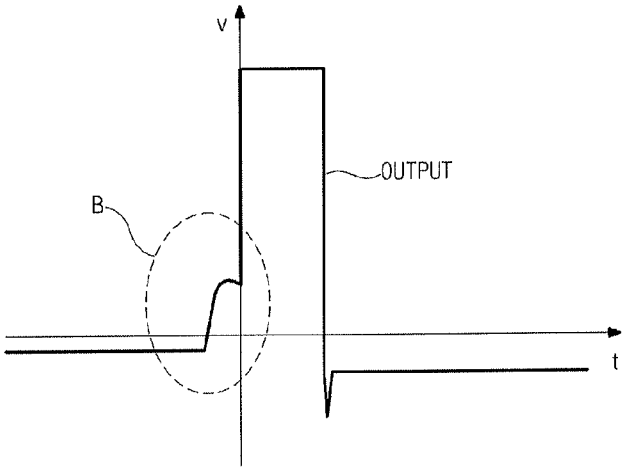
FIG. 5 RELATED ART
FIG. 5 is a view timing chart of an output pulse at the driving unit of the control signal circuit according to the related art.

A plurality of control signals are required to operate the pixel P of the display panel 110, and a control signal circuit to generate the control signals may be employed in the display device 100. The control signals may include the control signal, the light emitting control signal and the select signal as shown in FIG. 2.

Referring to FIG. 7, the control signal circuit may include a plurality of driving units 150 and a plurality of reverse circuits.

Each driving unit 150 includes first and second transistors T1 and T2, and outputs a first output pulse SR_out using a clock signal CLK and the like supplied from the timing control portion 140.

The first and second transistors T1 and T2 may be PMOS type transistors.

The first output pulse SR_out is supplied to the switching element of the pixel P and controls turning on/off the switching element.

The driving unit 150 functions to transfers the clock signal CLK to the output node N1 according to the Q signal and the Qb signal. The Q signal and the Qb signal are voltages at the Q node and the Qb node, respectively.

Accordingly, the first output pulse SR_out can have the same waveform as the clock signal CLK.

A reverse circuit (not shown) functions to reverse the first output pulse SR_out and output the reversed pulse. For example, an inverter is used as the reverse circuit.

Accordingly, a second output pulse OUT of the control signal circuit may be the reversed pulse from the reverse circuit.

As such, the clock signal CLK of the embodiment has the waveform opposite in phase to the second output pulse OUT.

In the related art, the output pulse of the control signal circuit has the same waveform as the clock signal CLK.

In this case, the clock signal CLK and the Q signal have a low level at the same time, thus the Vgs of the is 0V and the first transistor T1 is thus turned off, and the Qb node is high level and the second transistor is thus turned off, and finally, the output node N has a floating state. Accordingly, deformation of the output pulse is caused.

However, according to the embodiment, the clock signal CLK having the waveform opposite to the second output pulse OUT is used to generate the output pulse of the control signal circuit.

Operation of the control signal circuit using the clock signal CLK having the reverse waveform of the output pulse OUT is explained in more detail with reference to FIGS. 8 and 9.

Referring to FIG. 8, for a first time t1, the clock signal CLK maintains a high level, and the Q signal changes from a high level to a first low level according to a previous output pulse.

The previous output pulse may be defined as an output pulse from the previous driving unit 150.

Then, for a second time t2, the Q signal changes from a first low level to a second low level, and a clock signal CLK changes from a high level to a low level. The first low level is higher than the second low level.

Accordingly, for the first time t1, when the Q signal changes to the first low level, the first transistor T1 is turned on, and the clock signal has the high level. Accordingly, the clock signal CLK and the Q signal can be prevented from having the low level at the same time.

Therefore, the deformation of the output pulse due to the floating state of the output node N1 as shown in the related art can be prevented.

Further, for the second time t2, the source terminal of the first transistor T1 is supplied with the clock signal CLK having the low level, and the gate terminal of the first transistor T1 is supplied with the Q signal having the second low level. Accordingly, the gate and source terminals of the first transistor T1 have the same voltage level, and the gate terminal of the first transistor T1 i.e., the Q node can be prevented from having a floating state.

Therefore, referring to FIG. 9, for the first time t1, the first transistor T1 is turned on, thus the clock signal CLK having the high level is output as the first output pulse (SR_out), and thus the normal first output pulse SR_out can be output.

Further, for the second time t2, the first transistor T1 maintains the turned-on state, thus the clock signal CLK having the low level is output as the first output pulse SR_out, and thus the normal first output pulse SR_out can be output.

In addition, the control signal circuit can reverse the first output pulse SR_out from the driving unit 150 into the second output pulse OUT using the reverse circuit and then output it to the display panel 110.

As described above, the control signal circuit of the first embodiment generates the first output pulse SR_out using the clock signal CLK, which has the reverse waveform of the second output pulse OUT, reverses the first output pulse SR_out, and finally generates the normal second output pulse OUT without deformation.

However, in case of using the inverter as the reverse circuit, the second output pulse OUT is voltage-divided at an output terminal, and voltage level is thus caused to be lowered.

Figure 10:
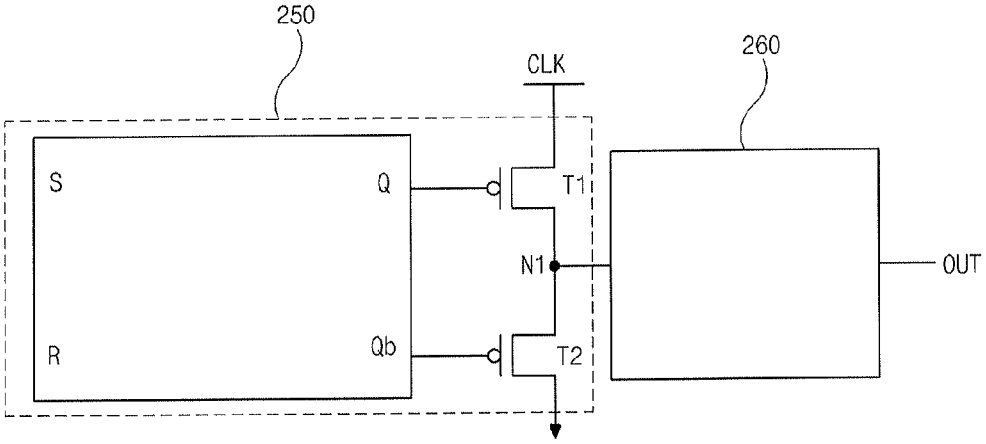
FIG. 10 is a view illustrating a driving unit and a reverse circuit of a control signal circuit according to a second embodiment of the present invention.
Figure 11:
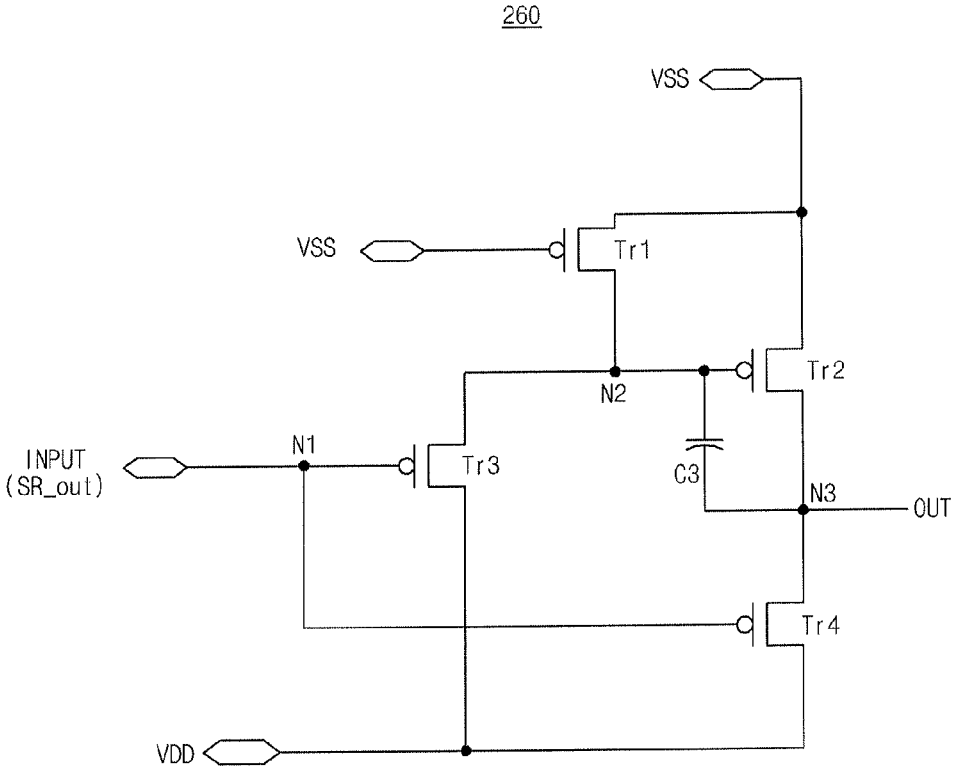
FIG. 11 is a circuit diagram of the reverse circuit according to the second embodiment of the present invention.
Figure 12:
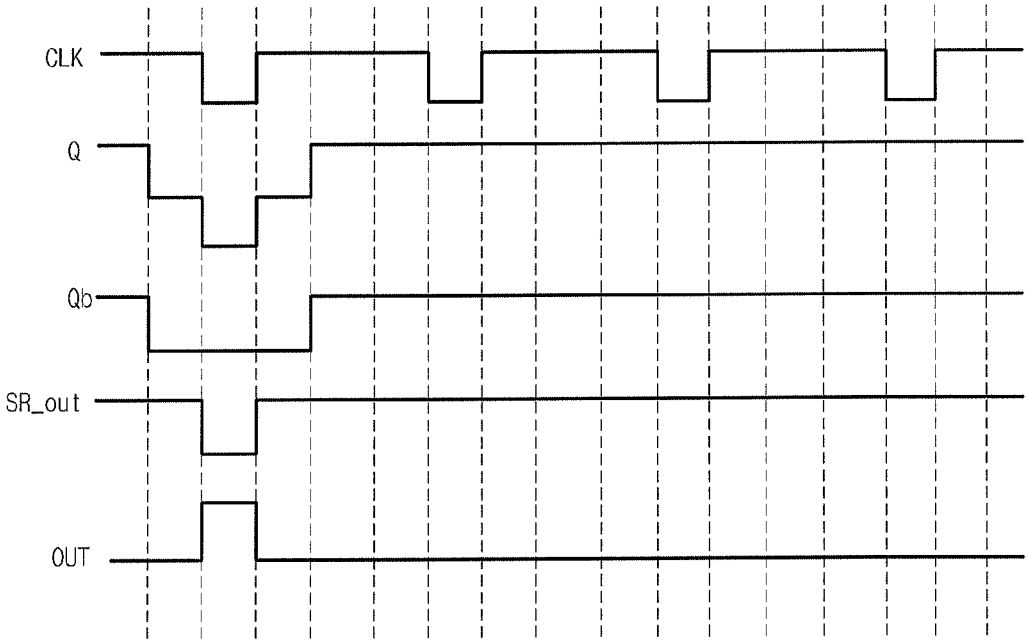
FIG. 12 is a timing chart of a clock signal, an output pulse at a Q node, an output pulse at a Qb node, an output pulse at a driving unit, and a reverse pulse of the control signal circuit according to the second embodiment of the present invention.

FIG. 10 is a view illustrating a driving unit and a reverse circuit of a control signal circuit according to a second embodiment of the present invention, FIG. 11 is a circuit diagram of the reverse circuit according to the second embodiment of the present invention, and FIG. 12 is a timing chart of a clock signal, an output pulse at a Q node, an output pulse at a Qb node, an output pulse at a driving unit, and a reverse pulse of the control signal circuit according to the second embodiment of the present invention.

Referring to FIG. 10, the control signal circuit may include a plurality of driving units 250 and a plurality of reverse circuits 260.

Each driving unit 250 includes first and second transistors T1 and T2, and outputs a first output pulse SR_out using a clock signal CLK and the like supplied from the timing control portion (140 of FIG. 6).

The first and second transistors T1 and T2 may be PMOS type transistors.

The first output pulse SR_out is supplied to the switching element of the pixel P and controls turning on/off the switching element.

The driving unit 250 functions to transfers the clock signal CLK to the output node N1 according to the Q signal and the Qb signal. The Q signal and the Qb signal are voltages at the Q node and the Qb node, respectively.

Accordingly, the first output pulse SR_out can have the same waveform as the clock signal CLK.

The clock signal CLK has the reverse waveform of the second output pulse OUT.

Operation of the reverse circuit 260 is explained in more detail with reference to FIGS. 11 and 12.

As mentioned in the above-described first embodiment, in case of using the inverter as the reverse circuit, the second output pulse OUT is voltage-divided at an output terminal, and voltage level is thus caused to be lowered.

To solve this problem, referring to FIG. 11, the reverse circuit 260 of the second embodiment includes third to sixth transistors Tr1 to Tr4 and a capacitor C3, and functions to reverse the first output pulse SR_out and output the reverse pulse.

The third to sixth transistors Tr1 to Tr4 may be PMOS type transistors.

Source and gate electrodes of the third transistor Tr1 are supplied with a low level driving voltage VSS, and a drain electrode of the third transistor Tr1 is connected to a gate electrode of the fourth transistor Tr2 i.e., a second node N2.

A source electrode of the fourth transistor Tr2 is supplied with the low level driving voltage VSS, a gate electrode of the fourth transistor Tr2 is connected to an electrode of the capacitor C3, and a drain electrode of the fourth transistor Tr2 is connected to the other electrode of the capacitor C3 i.e., a third node N3.

A source electrode of the fifth transistor Tr3 is connected to the second node N2, a gate electrode the fifth transistor Tr3 is supplied with the first output pulse SR_out as an input signal INPUT, and the drain electrode of the fifth transistor Tr3 is supplied with a high level driving voltage VDD.

A source electrode of the sixth transistor Tr4 is connected to the third node N3, a gate electrode the sixth transistor Tr4 is supplied with the first output pulse SR_out as the input signal INPUT, and the drain electrode of the sixth transistor Tr4 is supplied with the high level driving voltage VDD.

Regarding the operation of the reverse circuit 260, the third transistor Tr1 is supplied with the low level driving voltage VSS at the gate electrode thereof and maintains a turned-on state.

Accordingly, the gate electrode of the fourth transistor Tr2 i.e., the second node N2 continues to be supplied with the low level driving voltage VSS Accordingly, the output of the reverse circuit 260 can change according to a voltage level of the first output pulse SR_out as the input signal INPUT.

For example, when the first output pulse SR_out having a high level is supplied, the fifth and sixth transistors Tr3 and Tr4 are turned off.

In this case, the second node N2 is supplied to the low level driving voltage VSS, and the fourth transistor Tr2 is turned on. Accordingly, the low level driving voltage VSS is transferred to the third node N3.

In other words, when the first output signal SR_out having the high level is supplied, the level of voltage output to the output node of the reverse circuit 260 i.e., the third node N3 becomes a low level, the output is the reverse of the input.

When the first output pulse SR_out having a low level is supplied, the fifth and sixth transistors Tr3 and Tr4 are turned on.

In this case, the high level driving voltage VDD is transferred to the second node N2.

Accordingly, the second node N2 is supplied with the low level driving voltage VSS and the high level driving voltage VDD as well, thus a level of voltage of the second node N2 is raised, and thus the fourth transistor Tr2 is turned off.

The sixth transistor Tr4 is turned on, and the high level driving voltage VDD is transferred to the third node N3.

In other words, when the first output pulse SR_out is supplied, the level of voltage output to the output node of the reverse circuit 260 i.e., the third node N3 becomes a high level, the output is the reverse of the input.

As described above, the reverse circuit 260 can prevent the voltage-dividing that occurs due to turning on the fourth and sixth transistors Tr2 and Tr4 at the same time. Accordingly, the second output pulse OUT having a desired voltage level can be obtained.

In other words, when the reverse circuit 260 is used, the fifth transistor Tr3 is turned on at the same time as the sixth transistor Tr4 is turned, and thus the gate voltage of the fourth transistor Tr2 is raised. Accordingly, the turn-on resistance of the fourth transistor becomes very great, the second output pulse OUT is raised to the high level driving voltage VDD that is a desired-level voltage.

According to the above-described embodiments, the output pulse can be prevented from deformation using the clock signal having the reverse waveform of the output pulse, and a desired control signal can be obtained.

Further, the output pulse can be obtained without loss of voltage using the reverse circuit.

It will be apparent to those skilled in the art that various modifications and variations can be made in a display device of the present disclosure without departing from the sprit or scope of the invention. Thus, it is intended that the present invention covers the modifications and variations of this invention provided they come within the scope of the appended claims and their equivalents.

What is claimed is:

1. A display device comprising:

a display panel; and a control signal circuit that supplies a control signal to the display panel, the control signal circuit including a plurality of driving units and a plurality of reverse circuits, wherein a respective driving unit is supplied with a clock signal and generates a first output pulse that has the same waveform as the clock signal, wherein a respective reverse circuit reverses the first output pulse to generate a second output pulse that is an output of the control signal circuit, wherein the respective reverse circuit includes first to fourth transistors and a capacitor, wherein source and gate electrode of the first transistor are supplied with a low level driving voltage, and a drain electrode of the first transistor is connected to a gate electrode of the second transistor via a second node, wherein a source electrode of the second transistor is supplied with the low level driving voltage, the gate electrode of the second transistor is connected to an electrode of the capacitor, and the drain electrode of the second transistor is connected to the other electrode of the capacitor via a third node, wherein a source electrode of the third transistor is connected to the second node, a gate electrode of the third transistor is supplied with the first output pulse, and a drain electrode of the third transistor is supplied with a high level driving voltage, and wherein a source electrode of the fourth transistor is connected to the third node, a gate electrode of the fourth transistor is supplied with the first output pulse, and a drain electrode of the fourth transistor is supplied with the high level driving voltage.

2. The display device of claim 1 wherein the respective driving unit includes first and second transistors, wherein a gate electrode of the first transistor of the respective driving unit is supplied with a Q signal from a Q node of the driving unit, and a source electrode of the first transistor of the respective driving unit is supplied with the clock signal, and wherein a gate electrode of the second transistor of the respective driving unit is supplied with a Qb signal from a Qb node of the driving unit.

3. The display device of claim 2, wherein the Q signal has a first low level state for a first time and a second low level less than the first low level for a second time next to the first time, and wherein the clock signal has a low level for the second time.

4. A method of driving a display device, the method comprising generating a first output pulse that has the same waveform as a clock signal, and reversing the first output pulse to generating a second output pulse, through a control signal circuit, providing a control signal circuit that includes a plurality of driving units and a plurality of reverse circuits, supplying the control signal circuit with the clock signal, and supplying a control signal from the control signal circuit to a display panel, wherein the reverse circuit includes first to fourth transistors and a capacitor, wherein source and gate electrode of the first transistor are supplied with a low level driving voltage, and a drain electrode of the first transistor is connected to a gate electrode of the second transistor via a second node, wherein a source electrode of the second transistor is supplied with the low level driving voltage, the gate electrode of the second transistor is connected to an electrode of the capacitor, and the drain electrode of the second transistor is connected to the other electrode of the capacitor via a third node, wherein a source electrode of the third transistor is connected to the second node, a gate electrode of the third transistor is supplied with the first output pulse, and a drain electrode of the third transistor is supplied with a high level driving voltage, and wherein a source electrode of the fourth transistor is connected to the third node, a gate electrode of the fourth transistor is supplied with the first output pulse, and a drain electrode of the fourth transistor is supplied with the high level driving voltage.

5. The method of claim 4, wherein the driving unit includes first and second transistors, wherein a gate electrode of the first transistor of the driving unit is supplied with a Q signal from a Q node of the driving unit, and a source electrode of the first transistor of the driving unit is supplied with the clock signal, and wherein a gate electrode of the second transistor of the driving unit is supplied with a Qb signal from a Qb node of the driving unit.

6. The method of claim 5, wherein the Q signal has a first low level state for a first time and a second low level less than the first low level for a second time next to the first time, and wherein the clock signal has a low level for the second time.

* * * * *